US009552008B1

(12) United States Patent
Shimamune

(10) Patent No.: US 9,552,008 B1
(45) Date of Patent: Jan. 24, 2017

(54) VOLTAGE REGULATOR CIRCUIT

(71) Applicant: Murata Manufacturing Co., Ltd., Kyoto (JP)

(72) Inventor: Yusuke Shimamune, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 15/244,310

(22) Filed: Aug. 23, 2016

(30) Foreign Application Priority Data

Sep. 8, 2015 (JP) ..... 2015-176826

(51) Int. Cl.
*G05F 1/56* (2006.01)
*G05F 3/08* (2006.01)

(52) U.S. Cl.
CPC ..... *G05F 3/08* (2013.01)

(58) Field of Classification Search
CPC ..... G05F 1/56; G05F 1/575; G05F 1/468; G05F 3/08; G05F 3/10; G05F 3/16; H02M 3/156; H02M 3/155; H02M 3/157
USPC ..... 323/273, 274, 282, 283, 312, 318, 349,323/351
See application file for complete search history.

(56) References Cited

U.S. PATENT DOCUMENTS 6,049,200 A * 4/2000 Hayashimoto ..... G05F 1/565 323/269
7,622,902 B1 * 11/2009 Kao ..... G05F 1/575 323/276
8,237,418 B1 * 8/2012 Krishna ..... G05F 1/575 323/273
8,519,692 B2 * 8/2013 Nakashima ..... G05F 1/56 323/288
2003/0117189 A1 * 6/2003 Beghein ..... H03L 7/0895 327/156
2003/0147193 A1 * 8/2003 Hamon ..... G05F 1/573 361/87
2008/0094045 A1 * 4/2008 Lin ..... G05F 1/56 323/274
2008/0100276 A1 * 5/2008 Negoro ..... G05F 1/565 323/285
2010/0148742 A1 6/2010 Nakashima
2014/0117957 A1 * 5/2014 Usuda ..... G05F 1/575 323/280

(Continued)

FOREIGN PATENT DOCUMENTS

JP 2010-140254 A 6/2010
JP 2012-155395 A 8/2012
JP 2012-185595 A 9/2012

*Primary Examiner* — Adolf Berhane
(74) *Attorney, Agent, or Firm* — Pearne & Gordon LLP

(57) ABSTRACT

A voltage regulator circuit includes: an output transistor that controls an output voltage by making an output current flow between first and second electrodes in accordance with a first differential voltage, which is a difference between first and second voltages of the first and third electrodes; an operational amplifier that controls the second voltage such that the output voltage comes to be at a target level; an initiation circuit that maintains the second voltage at the third voltage such that the output transistor is off before initiation of the voltage regulator circuit and that allows the second voltage to be controlled by the operational amplifier after initiation of the voltage regulator circuit; and a current output circuit that outputs an adjustment current from the third electrode or to the third electrode such that the first differential voltage becomes larger when the output voltage is less than a prescribed level.

18 Claims, 12 Drawing Sheets

(56) References Cited

U.S. PATENT DOCUMENTS

| | | | | |
|---|---|---|---|---|
| 2014/0340067 | A1* | 11/2014 | Zhong | G05F 3/08 323/311 |
| 2015/0205313 | A1* | 7/2015 | Tomioka | G05F 1/575 323/280 |
| 2016/0285260 | A1* | 9/2016 | Kawasoe | H02H 9/045 |

* cited by examiner

VOLTAGE REGULATOR CIRCUIT

This application claims priority from Japanese Patent Application No. 2015-176826 filed on Sep. 8, 2015. The contents of this application is incorporated herein by reference in its entirety.

BACKGROUND

The present disclosure relates to a voltage regulator circuit. In recent years, there have been increasingly strong demands to shorten the rise time of the output voltage of voltage regulator circuits. In response to such demands, in a voltage regulator circuit disclosed in Japanese Unexamined Patent Application Publication No. 2010-140254 for example, the gate voltage of an output MOS transistor is controlled when the voltage regulator circuit is initiated so that the output voltage comes to be within a prescribed voltage range in a short time. Specifically, a voltage generated through voltage division using two capacitance elements is supplied to the gate of the output MOS transistor.

In the voltage regulator circuit disclosed in Japanese Unexamined Patent Application Publication No. 2010-140254, there is a possibility that an overshoot will occur when the output voltage rises in the case where there is a difference between the voltage supplied to the gate of the output MOS transistor at the time when the voltage regulator circuit is initiated and the voltage supplied at the time when the output voltage has reached a target level. Therefore, variations in characteristics caused by such an overshoot are an issue even through the rise speed is improved.

BRIEF SUMMARY

The present disclosure was made in light of the above-described circumstances and to the present disclosure provides a voltage regulator circuit that can improve the rise speed without necessarily the generation of an overshoot when the output voltage rises.

A voltage regulator circuit, which outputs an output voltage of a target level that corresponds to a reference voltage, according to an embodiment of the present disclosure includes: an output transistor that controls the output voltage by making an output current flow between first and second electrodes in accordance with a first differential voltage, which is a difference between a first voltage of the first electrode and a second voltage of a third electrode; an operational amplifier that controls the second voltage such that the output voltage comes to be at the target level; an initiation circuit that maintains the second voltage at the third voltage such that the output transistor is off before initiation of the voltage regulator circuit and that allows the second voltage to be controlled by the operational amplifier after initiation of the voltage regulator circuit; and a current output circuit that outputs an adjustment current from the third electrode or to the third electrode such that the first differential voltage becomes larger when the output voltage is less than a prescribed level.

According to the embodiment of the present disclosure, a voltage regulator circuit can be provided that can improve the rise speed without necessarily generating an overshoot when an output voltage rises.

Other features, elements, characteristics and advantages of the present disclosure will become more apparent from the following detailed description of embodiments of the present disclosure with reference to the attached drawings.

BRIEF DESCRIPTION OF THE SEVERAL VIEWS OF DRAWINGS

DETAILED DESCRIPTION

Figure 1:
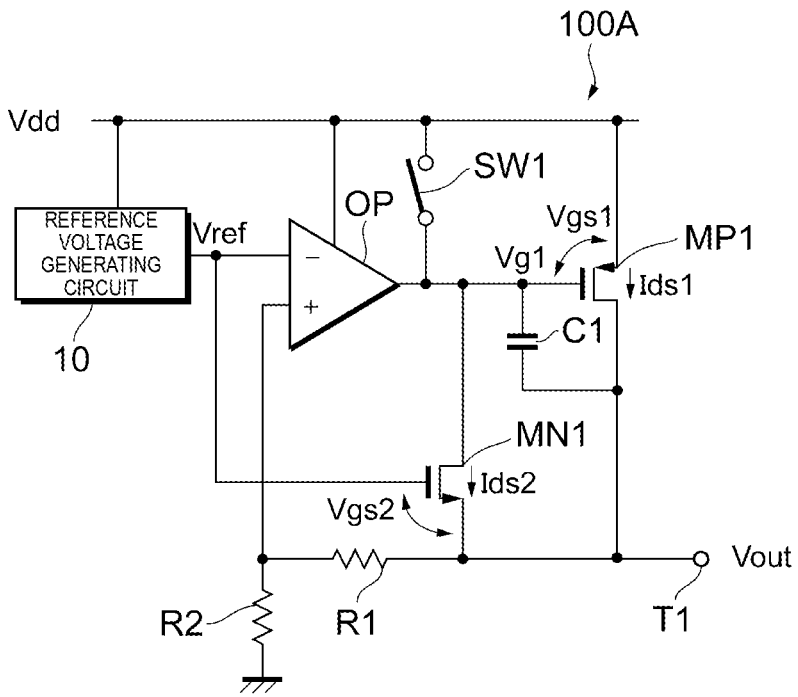
FIG. 1 is a circuit diagram of a voltage regulator circuit according to a first embodiment of the present disclosure.

Hereafter, embodiments of the present disclosure will be described in detail while referring to the drawings. In addition, elements that are the same as each other will be denoted by the same symbols and repeated description thereof will be omitted.

First Embodiment

FIG. 1 illustrates a voltage regulator circuit 100A, which is an example of a voltage regulator circuit of the present disclosure. The voltage regulator circuit 100A steps down a power supply voltage Vdd (for example, around 3.0 V) and outputs an output voltage Vout of a target level (for example, around 2.5 V) on the basis of a prescribed reference voltage Vref (for example, around 1.2 V).

As illustrated in FIG. 1, the voltage regulator circuit 100A includes a reference voltage generating circuit 10, a p-channel MOSFET (MP1), an n-channel MOSFET (MN1), a switch circuit SW1, an operational amplifier OP, a capacitor C1 and resistance elements R1 and R2.

The reference voltage generating circuit 10 is a circuit that outputs the reference voltage Vref on the basis of the power supply voltage Vdd. The reference voltage Vref is output in response to an initiation signal that instructs initiation of the voltage regulator circuit 100A.

The p-channel MOSFET (MP1) (output transistor) has the power supply voltage Vdd supplied to the source thereof (first electrode), the drain thereof (second electrode) is connected to an output terminal T1 and the gate thereof (third electrode) is connected to an output terminal of the operational amplifier OP. The p-channel MOSFET (MP1)

controls the output voltage Vout by making a current Ids' flow from the source to the drain in accordance with a gate-source voltage Vgs1 (first differential voltage), which is the difference between a source voltage (first voltage) and a gate voltage (second voltage: Vg1).

The n-channel MOSFET (MN1) (first transistor) is a current output circuit that outputs an adjustment current Ids2. The n-channel MOSFET (MN1) has the source thereof (fourth electrode) connected to the output terminal T1, has the drain thereof (fifth electrode) connected to the output terminal of the operational amplifier OP and the reference voltage Vref is supplied to the gate thereof (sixth electrode). The n-channel MOSFET (MN1) makes the adjustment current Ids2 flow from the drain to the source thereof in accordance with a gate-source voltage Vgs2 thereof (second differential voltage), which is the difference between the source voltage (fourth voltage) and the gate voltage (fifth voltage) thereof. As a result of this adjustment current Ids2 being supplied, a gate voltage Vg1 of the p-channel MOSFET decreases and an increase in the gate-source voltage Vgs1 is promoted.

The switch circuit SW1 (initiation circuit) controls the state of the gate voltage of the p-channel MOSFET (MP1) in accordance with an initiation signal that instructs initiation of the voltage regulator circuit 100A. The switch circuit SW1 has the power supply voltage Vdd (third voltage) supplied to one end thereof and the other end thereof is connected to the output terminal of the operational amplifier OP. Before initiation of the voltage regulator circuit 100A (before input of initiation signal), the switch circuit SW1 is on and the gate voltage of the p-channel MOSFET (MP1) is maintained at the power supply voltage Vdd. Thus, the p-channel MOSFET (MP1) is maintained off. After initiation of the voltage regulator circuit 100A (after input of initiation signal), the switch circuit SW1 is turned off and it becomes possible for the gate voltage of the p-channel MOSFET (MP1) to be controlled by the operational amplifier OP. The switch circuit SW1 can be configured using a transistor, for example.

The operational amplifier OP has the reference voltage Vref supplied to an inverting input terminal thereof, has a voltage obtained by dividing the output voltage Vout using the resistance elements R1 and R2 supplied to a non-inverting input terminal thereof and has the output terminal thereof connected to the gate of the p-channel MOSFET (MP1).

The capacitor C1 (second capacitor) has one end thereof connected to the gate of the p-channel MOSFET (MP1) and the other end thereof connected to the drain of the p-channel MOSFET (MP1). The capacitor C1 is provided for phase compensation.

The resistance element R1 has one end thereof connected to the output terminal T1 and the other end thereof connected to one end of the resistance element R2. The other end of the resistance element R2 is grounded.

Figure 2:
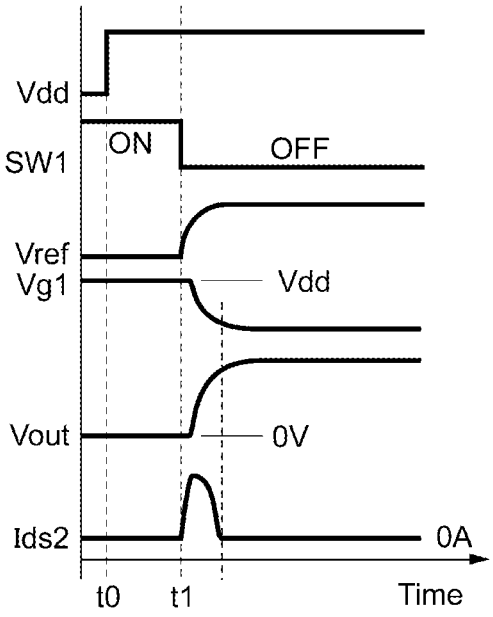
FIG. 2 is a timing chart for individual parts of the voltage regulator circuit according to the first embodiment of the present disclosure.

Operation of the thus-configured voltage regulator circuit 100A will be described while referring to FIGS. 1 and 2. FIG. 2 is a timing chart that illustrates an example of operation of the voltage regulator circuit 100A. In FIG. 2, time t0 represents the time when the power supply voltage Vdd is input and time t1 represents the time when the initiation signal is input to the voltage regulator circuit 100A~100I and 100J.

First, the description will focus on the p-channel MOSFET (MP1). Before initiation of the voltage regulator circuit 100A, the switch circuit SW1 is in an on state and therefore the gate voltage Vg1 is the power supply voltage Vdd and the p-channel MOSFET (MP1) is maintained in an off state. When the switch circuit SW1 transitions to an off state from the on state in response to the initiation signal at time t1, the operational amplifier OP operates so that the non-inverting input terminal and the inverting input terminal thereof come to be the same potential and as a result the gate voltage Vg1 gradually falls. Once the gate-source voltage Vgs1 of the p-channel MOSFET (MP1) becomes equal to or higher than a threshold voltage Vth1 of the p-channel MOSFET (MP1), the current Ids' begins to flow from the source to the drain. The gate voltage Vg1 gradually falls from the level thereof prior to initiation (power supply voltage Vdd) and settles at a prescribed level and the output voltage Vout of the target level is output.

Next, the description will focus upon the n-channel MOSFET (MN1). The gate voltage of the n-channel MOSFET (MN1) is the reference voltage Vref and the source voltage of the re-channel MOSFET (MN1) is the output voltage Vout. Since the output voltage Vout is 0 V at time t1, the gate-source voltage Vgs2 of the n-channel MOSFET (MN1) is equal to reference voltage Vref. Assuming that the reference voltage Vref is higher than a threshold voltage Vth2 of the n-channel MOSFET (MN1), the adjustment current Ids2 begins to flow from the drain to the source of the n-channel MOSFET (MN1) immediately after time t1. When the output voltage Vout gradually rises due to the operation of the operational amplifier OP, the gate-source voltage Vgs2 of the n-channel MOSFET (MN1) decreases. When the gate-source voltage Vgs2 of the n-channel MOSFET (MN1) becomes less than the threshold voltage Vth2, the adjustment current Ids2 stops. Therefore, when rising, the gate voltage Vg1 of the p-channel MOSFET (MP1) can be made to be the voltage at the time of steady operation.

With the above-described configuration, when the voltage regulator circuit 100A is initiated, the n-channel MOSFET (MN1) pulls a current from between the output terminal of the operational amplifier OP and the gate of the p-channel MOSFET (MP1). Therefore, compared with a configuration in which the re-channel MOSFET (MN1) is not provided, the gate voltage Vg1 of the p-channel MOSFET (MP1) falls more quickly. Consequently, the gate-source voltage Vgs1 of the p-channel MOSFET (MP1) rises more quickly and the p-channel MOSFET (MP1) transitions to an on state sooner. Therefore, the period from when the voltage regulator circuit 100A is initiated up to when the output voltage reaches the target level (rise time) is shortened. Furthermore, the gate-source voltage Vgs2 of the n-channel MOSFET (MN1) becomes less than the threshold voltage Vth2 before the output voltage Vout reaches a design value, that is, the target value, and the acceleration effect due to the adjustment current Ids2 flowing through the n-channel MOSFET (MN1) is stopped. After that, the output voltage Vout rises to the target value at a slower response speed determined by the band (AC characteristics) of the voltage regulator circuit 100A, which are determined by the circuit of the operational amplifier OP and the capacitance value of the capacitor C1, and therefore an overshoot is not generated.

In addition, the gate-source voltage Vgs2 of the re-channel MOSFET (MN1) gradually falls while the output voltage Vout of the voltage regulator circuit 100A approaches the target level and once the gate-source voltage Vgs2 becomes lower than the threshold voltage Vth2, the n-channel MOSFET (MN1) automatically transitions to the off state. Therefore, once the output voltage Vout has come close the target level, the adjustment current Ids2 does not flow and excessive current is not consumed.

Second Embodiment

Figure 3:
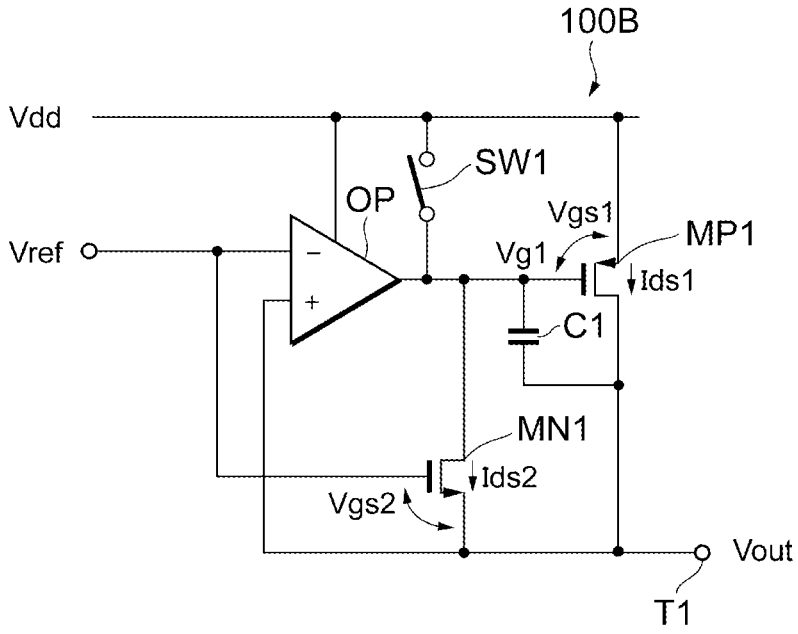
FIG. 3 is a circuit diagram of a voltage regulator circuit according to a second embodiment of the present disclosure.

FIG. 3 illustrates a voltage regulator circuit 100B, which is another example of a voltage regulator circuit of the present disclosure. The reference voltage generating circuit 10 is omitted. In addition, elements that are the same as those of the voltage regulator circuit 100A are denoted by the same symbols and description thereof is omitted.

The voltage regulator circuit 100B has the same configuration as the voltage regulator circuit 100A illustrated in FIG. 1 except that the voltage regulator circuit 100B does not include the resistance elements R1 and R2. As illustrated in FIG. 3, the output terminal is connected to the non-inverting input terminal of the operational amplifier OP in the voltage regulator circuit 100B. Therefore, the voltage regulator circuit 100B operates such that the output voltage Vout becomes equal to the reference voltage Vref. With this configuration as well, the same effect as with the voltage regulator circuit 100A can be obtained.

Third Embodiment

Figure 4:
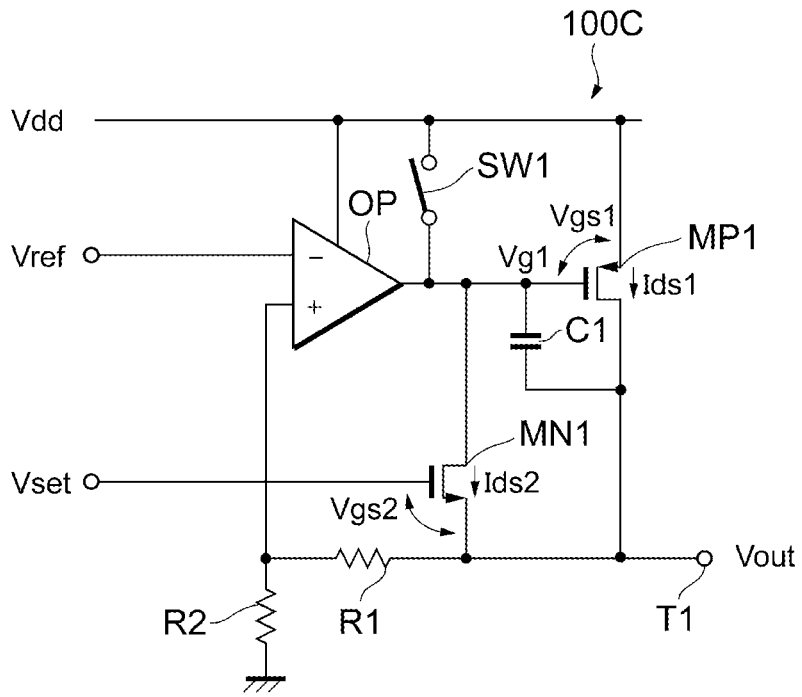
FIG. 4 is a circuit diagram of a voltage regulator circuit according to a third embodiment of the present disclosure.

FIG. 4 illustrates a voltage regulator circuit 100C, which is another example of a voltage regulator circuit of the present disclosure. The reference voltage generating circuit 10 is omitted. In addition, elements that are the same as those of the voltage regulator circuit 100A are denoted by the same symbols and description thereof is omitted.

The voltage regulator circuit 100C has the same configuration as the voltage regulator circuit 100A illustrated in FIG. 1 except that a voltage Vset is supplied from outside the voltage regulator circuit 100C to the gate of the n-channel MOSFET (MN1). The voltage Vset can be set to a voltage that is higher than the reference voltage Vref, for example.

In the voltage regulator circuit 100C, when the gate-source voltage Vgs2 of the n-channel MOSFET (MN1) becomes lower than the threshold voltage Vth2, the adjustment current Ids2 does not flow. Therefore, the voltage Vset, which is higher than the reference voltage Vref, is supplied to the gate of the n-channel MOSFET (MN1), and consequently the time taken until the gate-source voltage Vgs2 becomes lower than the threshold voltage Vth2 becomes longer than in the case where the reference voltage Vref is supplied to the gate. In other words, in the voltage regulator circuit 100C, the adjustment current Ids2 can be made to flow for a longer time compared with the voltage regulator circuit 100A. Consequently, in the voltage regulator circuit 100C, the period over which promotion of the decrease of the gate voltage Vg1 of the p-channel MOSFET (MP1) persists is longer and the effect of shortening the rise time of the output voltage Vout is improved compared with the voltage regulator circuit 100A.

Furthermore, in the case where the voltage Vset is higher than the reference voltage Vref, the initial value of the adjustment current Ids2 is larger than in the case where the reference voltage Vref is supplied to the gate of the n-channel MOSFET (MN1). As a result of this as well, the effect of shortening the rise time of the output voltage Vout is improved with the voltage regulator circuit 100C, compared with the voltage regulator circuit 100A.

Fourth Embodiment

Figure 5:
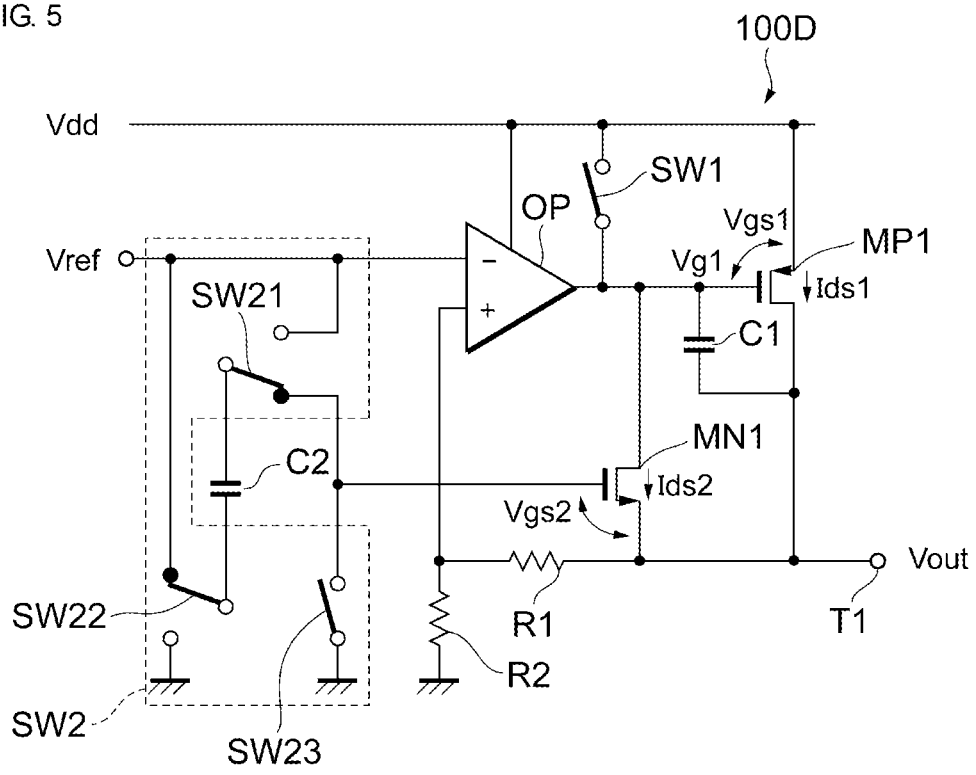
FIG. 5 is a circuit diagram of a voltage regulator circuit according to a fourth embodiment of the present disclosure.

FIG. 5 illustrates a voltage regulator circuit 100D, which is another example of a voltage regulator circuit of the present disclosure. The reference voltage generating circuit 10 is omitted. In addition, elements that are the same as those of the voltage regulator circuit 100A are denoted by the same symbols and description thereof is omitted.

In addition to the constituent components of the voltage regulator circuit 100A illustrated in FIG. 1, the voltage regulator circuit 100D further includes a booster circuit that generates a voltage that is higher than the reference voltage Vref. The booster circuit includes a capacitor C2 (first capacitor) and a switch circuit SW2 (first switch circuit).

The switch circuit SW2 includes switches SW21, SW22 and SW23. The switch SW21 supplies the reference voltage Vref to one end of capacitor C2 or connects the one end of the capacitor C2 to the gate of the n-channel MOSFET (MN1). The switch SW22 connects the other end of the capacitor C2 to ground or supplies the reference voltage Vref to the other end of the capacitor C2. The switch SW23 has one end thereof connected to the gate of the n-channel MOSFET (MN1) and the other end thereof is grounded.

Before initiation of the voltage regulator circuit 100D (before input of the initiation signal), the switch SW21 supplies the reference voltage Vref to the one end of the capacitor C2, the switch SW22 grounds the other end of the capacitor C2, and the switch SW23 is on. In this state, the capacitor C2 is charged by the reference voltage Vref.

After initiation of the voltage regulator circuit 100D (after input of the initiation signal), the switch SW21 connects the one end of the capacitor C2 to the gate of the n-channel MOSFET (MN1), the switch SW22 supplies the reference voltage Vref to the other end of the capacitor C2, and the switch SW23 is off. Thus, a voltage that is around twice the size of the reference voltage Vref is supplied to the gate of the n-channel MOSFET (MN1) when the voltage regulator circuit 100D is initiated.

Therefore, with the voltage regulator circuit 100D, the effect of shortening the rise time of the output voltage Vout is improved, similarly to as with the voltage regulator circuit 100C (third embodiment).

Fifth Embodiment

Figure 6:
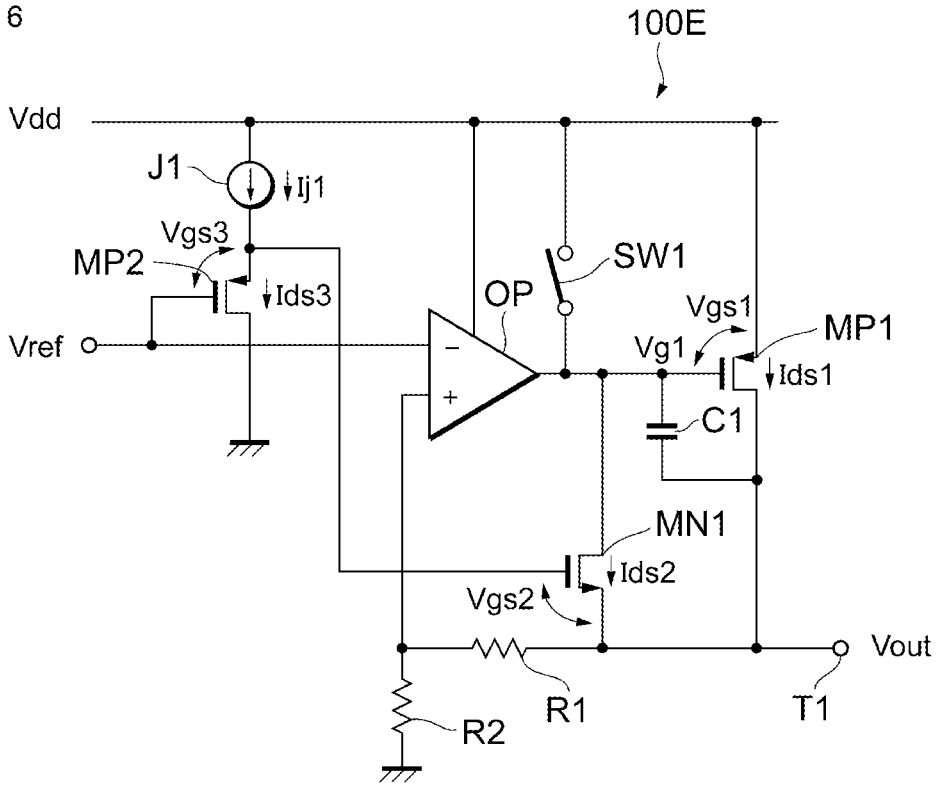
FIG. 6 is a circuit diagram of a voltage regulator circuit according to a fifth embodiment of the present disclosure.

FIG. 6 illustrates a voltage regulator circuit 100E, which is another example of a voltage regulator circuit of the present disclosure. The reference voltage generating circuit 10 is omitted. In addition, elements that are the same as those of the voltage regulator circuit 100A are denoted by the same symbols and description thereof is omitted.

The voltage regulator circuit 100E has the same configuration as the voltage regulator circuit 100A illustrated in FIG. 1 except that the voltage regulator circuit 100E further includes a current source J1 and a p-channel MOSFET (MP2).

The current source J1 outputs a constant current Ij1.

The p-channel MOSFET (MP2) (second transistor) has the current Ij1 supplied to the source thereof (seventh electrode), the drain thereof (eighth electrode) is grounded and the reference voltage Vref is supplied to the gate thereof (ninth electrode). The p-channel MOSFET (MP2) sets a gate-source voltage Vgs3 thereof (third differential voltage) in accordance with the current Ij1 (=current Ids3 that flows through p-channel MOSFET (MP2)) and the value of the reference voltage Vref.

Furthermore, the source of the p-channel MOSFET (MP2) is connected to the gate of the n-channel MOSFET (MN1). Thus, a voltage that is higher than the reference voltage Vref by the size of the gate-source voltage Vgs3 (Vref+Vgs3) is supplied to the gate of the n-channel MOSFET (MN1).

Therefore, with the voltage regulator circuit 100E, the effect of shortening the rise time of the output voltage Vout is improved, similarly to as with the voltage regulator circuit 100C (third embodiment). Furthermore, compared with the voltage regulator circuit 100D (fourth embodiment), there is no need to consider the sequence of control signals for the switch circuit SW2 when initiating the voltage regulator circuit and therefore the booster circuit can be simply implemented in the voltage regulator circuit 100E.

Sixth Embodiment

Figure 7:
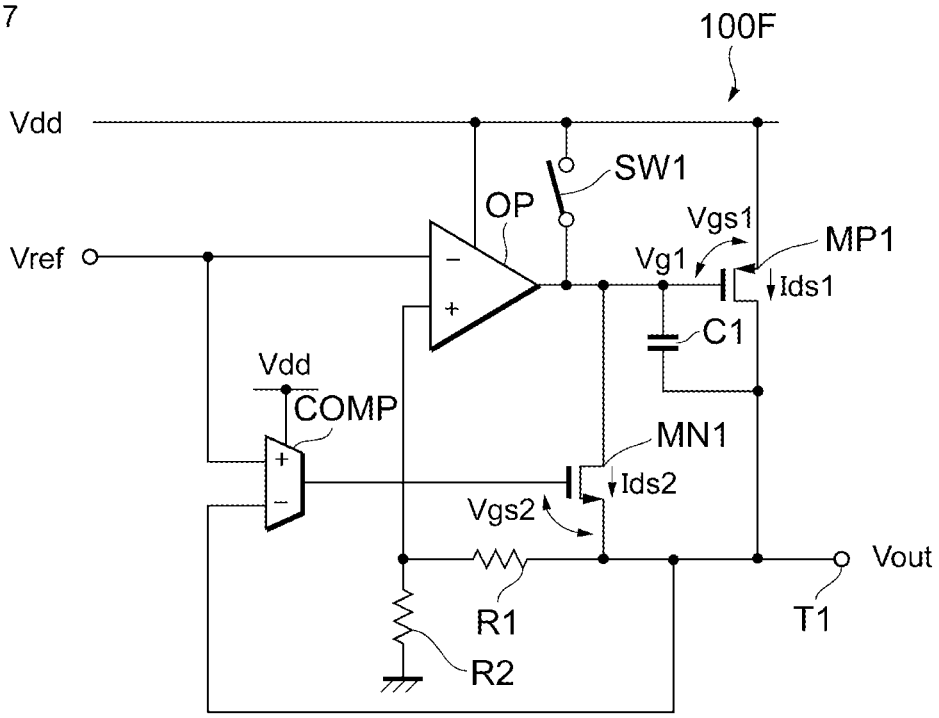
FIG. 7 is a circuit diagram of a voltage regulator circuit according to a sixth embodiment of the present disclosure.

FIG. 7 illustrates a voltage regulator circuit 100F, which is another example of a voltage regulator circuit of the present disclosure. The reference voltage generating circuit 10 is omitted. In addition, elements that are the same as those of the voltage regulator circuit 100A are denoted by the same symbols and description thereof is omitted.

The voltage regulator circuit 100F has the same configuration as the voltage regulator circuit 100A illustrated in FIG. 1 except that the voltage regulator circuit 100F further includes a comparator COMP.

The comparator COMP has the reference voltage Vref (sixth voltage) supplied to the non-inverting input terminal thereof and the output voltage Vout (seventh voltage) supplied to the inverting input terminal thereof, and the output terminal thereof is connected to the gate of the n-channel MOSFET (MN1). The comparator COMP outputs a high level (for example, the power supply voltage Vdd) (first level) in the case where the output voltage Vout is lower than the reference voltage Vref and outputs a low level (for example, 0 V) (second level) in the case where the output voltage Vout is higher than the reference voltage Vref on the basis of a comparison result of comparing two input voltages. The high level is a level at which the n-channel MOSFET (MN1) is turned on while the output of the comparator COMP is at the high level. For example, in the case where the high level is taken to be the power supply voltage Vdd, the gate-source voltage Vgs2 of the n-channel MOSFET (MN1)=the power supply voltage Vdd−the output voltage Vout>the threshold voltage Vth2 of the n-channel MOSFET (MN1) is satisfied.

When the voltage regulator circuit 100F is initiated, the output voltage Vout is 0 V and therefore the output of the comparator COMP is the high level. Consequently, the n-channel MOSFET (MN1) is turned on and the adjustment current Ids2 begins to flow. After that, the adjustment current Ids2 continues to flow while the output voltage Vout is lower than the reference voltage Vref.

The output voltage Vout rises, and when the output voltage Vout becomes higher than the reference voltage Vref, the output of the comparator COMP becomes the low level. As a result, the n-channel MOSFET (MN1) is turned off and the adjustment current Ids2 stops.

With this configuration, the adjustment current Ids2 can continue to be made to flow while the output voltage Vout is lower than the reference voltage Vref regardless of the threshold voltage Vth2 of the n-channel MOSFET (MN1). Therefore, with the voltage regulator circuit 100F, the effect of shortening the rise time of the output voltage Vout is improved, similarly to as with the voltage regulator circuit 100C (third embodiment).

Seventh Embodiment

Figure 8:
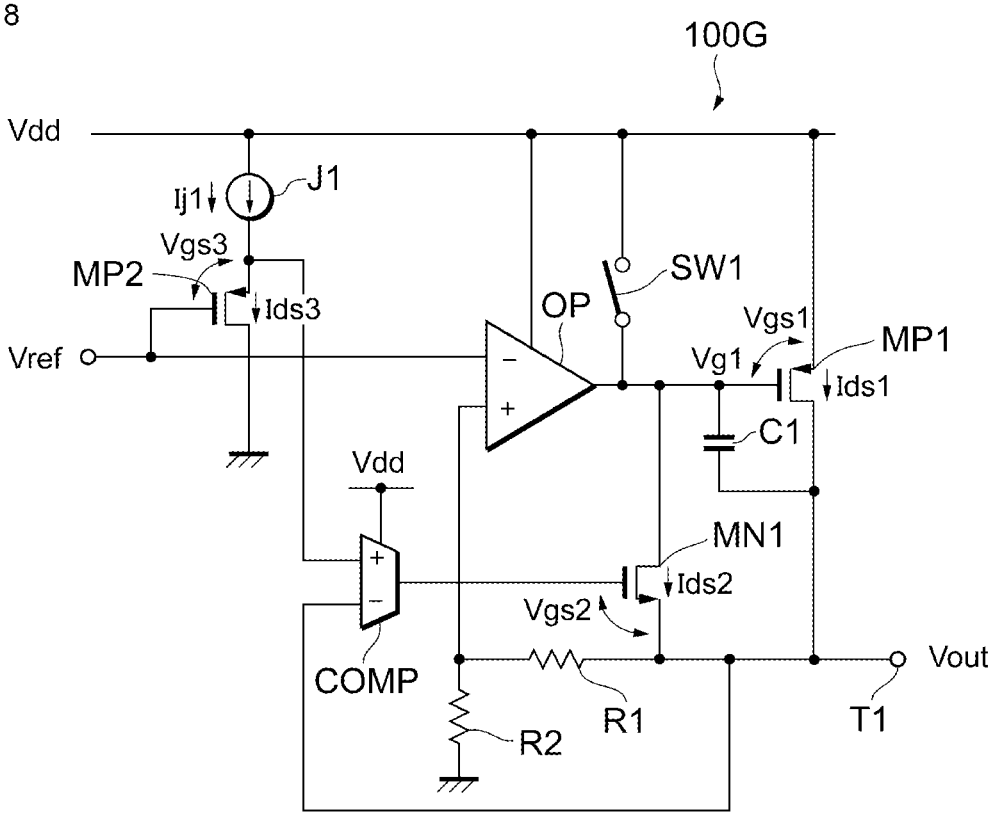
FIG. 8 is a circuit diagram of a voltage regulator circuit according to a seventh embodiment of the present disclosure.

FIG. 8 illustrates a voltage regulator circuit 100G, which is another example of a voltage regulator circuit of the present disclosure. The reference voltage generating circuit 10 is omitted. In addition, elements that are the same as those of the voltage regulator circuits 100E and 100F are denoted by the same symbols and description thereof is omitted.

The voltage regulator circuit 100G has a configuration that is obtained by combining the configuration of the voltage regulator circuit 100E illustrated in FIG. 6 and the configuration of the voltage regulator circuit 100F illustrated in FIG. 7.

The comparator COMP has the non-inverting input terminal thereof connected to the source of the p-channel MOSFET (MP2), has the output voltage Vout supplied to the inverting input terminal thereof and the output terminal thereof is connected to the gate of the n-channel MOSFET (MN1).

With this configuration, similarly to as with the voltage regulator circuit 100F (sixth embodiment), the adjustment current Ids2 can be made to flow regardless of the threshold voltage Vth2 of the n-channel MOSFET (MN1).

In addition, in the voltage regulator circuit 100G, the comparison target, which is to be compared with the output voltage Vout in the comparator COMP, is a voltage that is higher than the reference voltage Vref (Vref+Vgs3), and therefore the adjustment current Ids2 can be made to flow for a longer period than with the voltage regulator circuit 100F (sixth embodiment).

Eighth Embodiment

Figure 9:
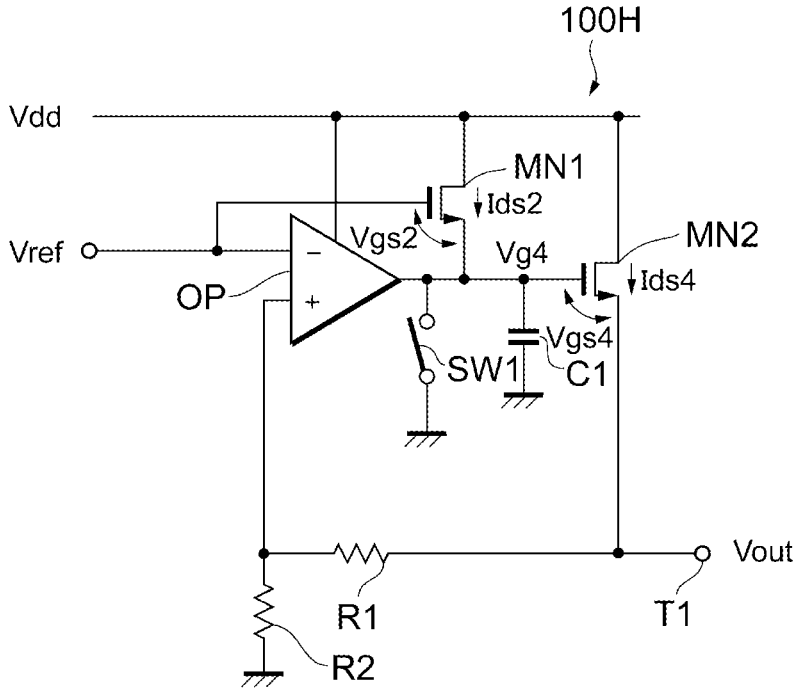
FIG. 9 is a circuit diagram of a voltage regulator circuit according to an eighth embodiment of the present disclosure.

FIG. 9 illustrates a voltage regulator circuit 100H, which is another example of a voltage regulator circuit of the present disclosure. The reference voltage generating circuit 10 is omitted. In addition, elements that are the same as those of the voltage regulator circuit 100A are denoted by the same symbols and description thereof is omitted.

The configuration of the voltage regulator circuit 100H differs from that of the voltage regulator circuit 100A illustrated in FIG. 1 in that an n-channel MOSFET (MN2) is used instead of the p-channel MOSFET (MP1).

The n-channel MOSFET (MN2) (output transistor) has the power supply voltage Vdd supplied to the drain thereof (second electrode), the source thereof (first electrode) is connected to the output terminal T1 and the gate thereof (third electrode) is connected to the output terminal of the operational amplifier OP.

The n-channel MOSFET (MN1) has the power supply voltage Vdd supplied to the drain thereof (fifth electrode), has the source thereof (fourth electrode) connected to the output terminal of the operational amplifier OP and has the reference voltage Vref supplied to the gate thereof (sixth electrode).

The output terminal of the operational amplifier OP is connected to the gate of the n-channel MOSFET (MN2).

The switch circuit SW1 has a ground voltage (third voltage) supplied to one end thereof and the other end thereof is connected to the output terminal of the operational amplifier OP.

One end of the capacitor C1 (second capacitor) is connected to the gate of the n-channel MOSFET (MN2) and the other end of the capacitor C1 is grounded.

Before initiation of the voltage regulator circuit 100H, a gate voltage Vg4 of the n-channel MOSFET (MN2) is maintained at 0 V and the n-channel MOSFET (MN2) is maintained in an off state.

After initiation of the voltage regulator circuit 100H, the n-channel MOSFET (MN1) outputs the adjustment current Ids2 in accordance with the gate-source voltage Vgs2 thereof. Immediately after initiation of the voltage regulator circuit 100H, the gate voltage Vg4 of the n-channel MOSFET (MN2) is 0 V and therefore the gate-source voltage Vgs2 of the n-channel MOSFET (MN1)=Vref. Assuming that the reference voltage Vref>the threshold voltage Vth2 of the n-channel MOSFET (MN1), the adjustment current Ids2 begins to flow immediately after initiation of the voltage regulator circuit 100H. After that, the gate voltage Vg4 of the n-channel MOSFET (MN2) rises due to the operation of the operational amplifier OP and a current Ids4 is made to flow from the drain to the source of the n-channel MOSFET (MN2). The output voltage Vout rises so as to approach the target level and once the gate-source voltage Vgs2 of the re-channel MOSFET (MN1) becomes lower than the threshold voltage Vth2, the adjustment current Ids2 stops.

Thus, with the voltage regulator circuit 100H, the rise of the gate voltage Vg4 of the n-channel MOSFET (MN2) is faster than in the configuration that does not include the n-channel MOSFET (MN1). Consequently, the time taken for the output voltage to reach the target level is shortened as in the voltage regulator circuit 100A (first embodiment). Furthermore, the gate-source voltage Vgs2 of the n-channel MOSFET (MN1) becomes less than the threshold voltage Vth2 before the output voltage Vout reaches the design value, which is the target value, and the acceleration effect due to the adjustment current Ids2 flowing through the n-channel MOSFET (MN1) is stopped. After that, the output voltage Vout rises to the target value at a slower response speed determined by the band (AC characteristics) of the voltage regulator circuit 100H, which is determined by the circuit of the operational amplifier OP and the capacitance value of the capacitor C1, and therefore an overshoot is not generated.

In addition, the gate-source voltage Vgs2 of the re-channel MOSFET (MN1) slowly falls as the source voltage of the n-channel MOSFET (MN1) rises and once the gate-source voltage Vgs2 becomes less than the threshold voltage Vth2, the n-channel MOSFET (MN1) automatically transitions to the off state. Therefore, the same effect as with the voltage regulator circuit 100A is also obtained with the voltage regulator circuit 100H.

Ninth Embodiment

Figure 10:
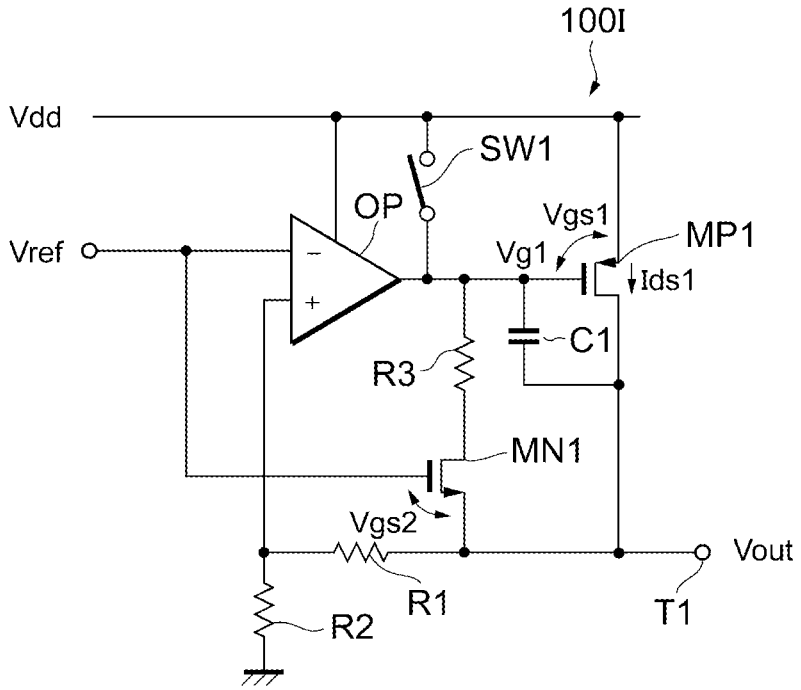
FIG. 10 is a circuit diagram of a voltage regulator circuit according to a ninth embodiment of the present disclosure.

FIG. 10 illustrates a voltage regulator circuit 100I, which is another example of a voltage regulator circuit of the present disclosure. The reference voltage generating circuit 10 is omitted. In addition, elements that are the same as those of the voltage regulator circuit 100A are denoted by the same symbols and description thereof is omitted.

The voltage regulator circuit 100I has the same configuration as the voltage regulator circuit 100A illustrated in FIG. 1 except that the voltage regulator circuit 100I further includes a resistance element R3.

One end of the resistance element R3 is connected to the output terminal of the operational amplifier OP and the other end of the resistance element R3 is connected to the drain of the n-channel MOSFET (MN1).

With this configuration, the peak value of the adjustment current Ids2 that flows to the n-channel MOSFET (MN1) can be restricted when the voltage regulator circuit 100I is initiated. Thus, the generation of a current spike in the line that supplies the power supply voltage Vdd when the voltage regulator circuit 100I is initiated can be suppressed.

Tenth Embodiment

Figure 11:
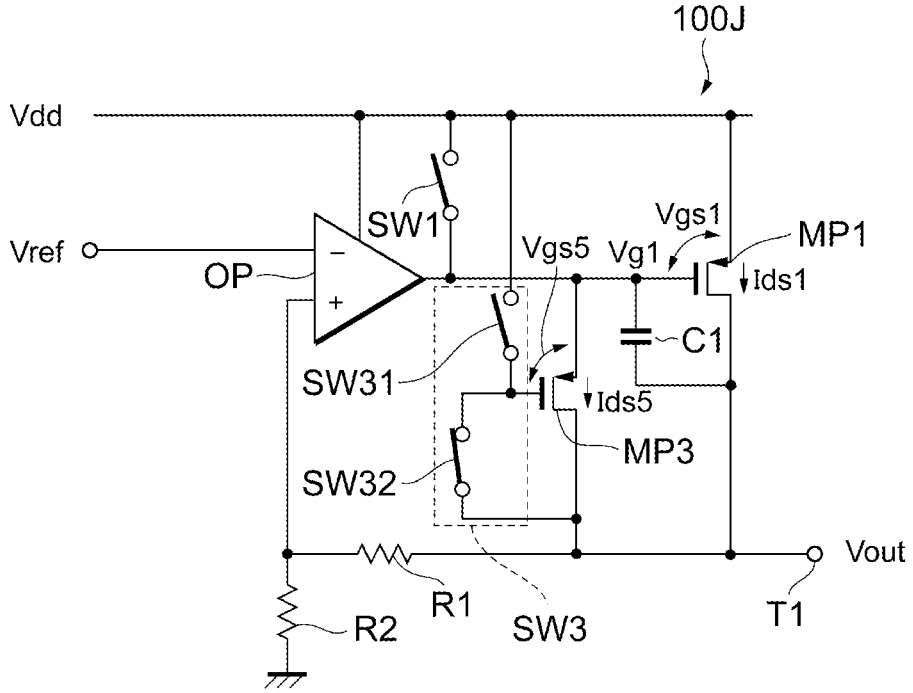
FIG. 11 is a circuit diagram of a voltage regulator circuit according to a tenth embodiment of the present disclosure.

FIG. 11 illustrates a voltage regulator circuit 100J, which is another example of a voltage regulator circuit of the present disclosure. The reference voltage generating circuit 10 is omitted. In addition, elements that are the same as those of the voltage regulator circuit 100A are denoted by the same symbols and description thereof is omitted.

The voltage regulator circuit 100J has the same configuration as the voltage regulator circuit 100A illustrated in FIG. 1 except that a p-channel MOSFET (MP3) is used instead of the n-channel MOSFET (MN1) and that the voltage regulator circuit 100J further includes a switch circuit SW3 (second switch circuit).

The p-channel MOSFET (MP3) (first transistor) has the source thereof (fourth electrode) connected to the output terminal of the operational amplifier OP, has the drain (fifth electrode) thereof connected to the output terminal T1 and has the power supply voltage Vdd or the output voltage Vout supplied to the gate thereof (sixth electrode).

The switch circuit SW3 includes switches SW31 and SW32. The power supply voltage Vdd is supplied to one end of the switch SW31 and the other end of the switch SW31 is connected to the gate of the p-channel MOSFET (MP3). One end of the switch SW32 is connected to the gate of the p-channel MOSFET (MP3) and the other end of the switch SW32 is connected to the drain of the p-channel MOSFET (MP3).

Before initiation of the voltage regulator circuit 100J (before input of the initiation signal), the switch SW31 is on and the switch SW32 is off. In this state, the power supply voltage Vdd is supplied to the gate of the p-channel MOSFET (MP3) and the p-channel MOSFET (MP3) is off.

After initiation of the voltage regulator circuit 100J (after input of the initiation signal), the switch SW31 is turned off and the switch SW32 is turned on. Consequently, the output voltage Vout is supplied to the gate of the p-channel MOSFET (MP3). The output voltage Vout is 0 V immediately after initiation of the voltage regulator circuit 100J, and therefore a gate-source voltage Vgs5 of the p-channel MOSFET (MP3)=the voltage of the output terminal of the operational amplifier OP (=Vdd). Assuming that the power supply voltage Vdd>a threshold voltage Vth5 of the p-channel MOSFET (MP3), an adjustment current Ids5 begins to flow immediately after initiation of the voltage regulator circuit 100J. After that, the gate voltage of the p-channel MOSFET (MP3) rises due to the output voltage Vout rising and once the gate-source voltage Vgs5 of the p-channel MOSFET (MP3) becomes less than the threshold voltage Vth5, the adjustment current Ids5 stops.

With this configuration as well, the same effect as with the voltage regulator circuit 100A can be obtained. In addition, since the output voltage Vout is supplied to the gate of the p-channel MOSFET (MP3), the timing at which the p-channel MOSFET (MP3) is turned off can be set without necessarily considering the value of the reference voltage Vref.

Simulation Results

Figure 12:
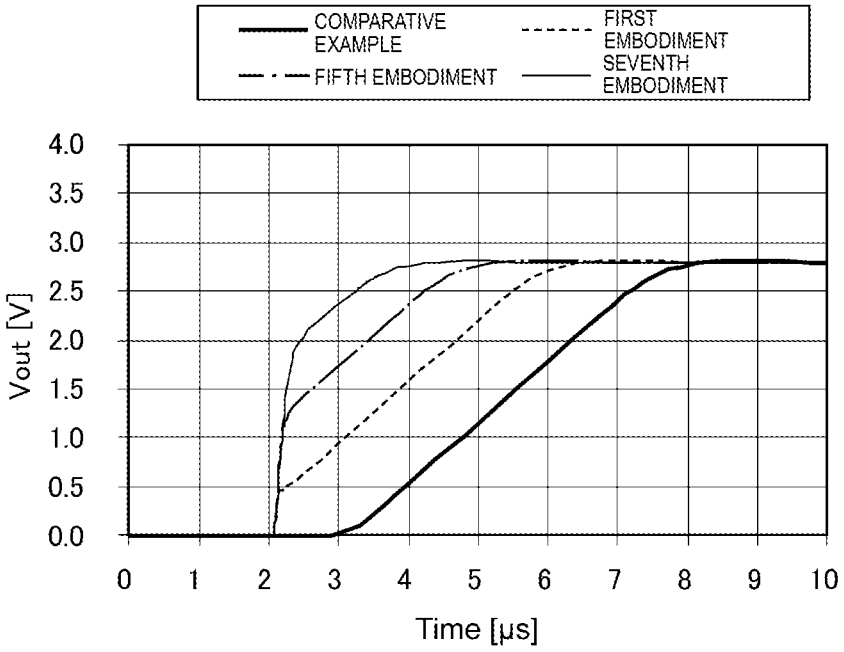
FIG. 12 is a graph illustrating simulation results for the rise time of an output voltage of voltage regulator circuits according to the first, fifth and seventh embodiments of the present disclosure and for a comparative example.

FIG. 12 is a graph illustrating simulation results for the rise times of the output voltages of the voltage regulator circuits according to the first, fifth and seventh embodiments of the present disclosure and of a comparative example. The comparative example is a voltage regulator circuit that does not include the n-channel MOSFET (MN1) among the constituent elements of the voltage regulator circuit 100A. In the graph illustrated in FIG. 12, the vertical axis represents the output voltage Vout (V) and the horizontal axis represents the time (μs) from when the power supply voltage Vdd is input. In the simulation, the switch circuit SW1 is turned off and the voltage regulator circuit is initiated at a time of 2 μs.

In the comparative example, a period of around 1 μs is required until the output voltage Vout starts to rise after the voltage regulator circuit is initiated, as illustrated in FIG. 12. This is because it takes time for the gate voltage of the p-channel MOSFET (MP1) to gradually decrease after initiation of the voltage regulator circuit and for the gate-source voltage Vgs1 of the p-channel MOSFET (MP1) to become higher than the threshold voltage Vth1.

In contrast, in the voltage regulator circuit 100A (first embodiment), it is clear that the output voltage Vout rises with a steep gradient immediately after the circuit is initiated and that there is an effect of the rise time of the output voltage Vout being shortened, as illustrated in FIG. 12. This is because falling of the gate voltage of the p-channel MOSFET (MP1) is promoted by the n-channel MOSFET (MN1).

Furthermore, with the voltage regulator circuit 100E (fifth embodiment), the voltage spends a longer time rising at the steep gradient and the effect of shortening of the rise time of the output voltage Vout is improved compared with the voltage regulator circuit 100A (first embodiment). This is because the voltage supplied to the gate of the n-channel MOSFET (MN1) is increased.

Furthermore, with the voltage regulator circuit 100G (seventh embodiment), the voltage spends an even longer time rising at the steep gradient and the effect of shortening of the rise time of the output voltage Vout is further improved compared with the voltage regulator circuit 100E (fifth embodiment). This is because the comparator COMP is used, in addition to there being the same voltage increase as in the voltage regulator circuit 100E (fifth embodiment), and consequently the on state of the n-channel MOSFET (MN1) is maintained until the output voltage Vout becomes a voltage (Vref+Vgs3) that is higher than the reference voltage Vref.

Specific values of the rise time of the output voltage Vout were 5.51 μs for the comparative example, 3.85 μs for the first embodiment, 2.59 μs for the fifth embodiment and 1.57 μs for the seventh embodiment.

Exemplary embodiments of the present disclosure have been described above. The voltage regulator circuits 100A to 100J include a transistor for outputting an adjustment current (n-channel MOSFET (MN1) or p-channel MOSFET (MP3)). This transistor outputs the adjustment current from or to the gate of the output transistor (p-channel MOSFET (MP1) or n-channel MOSFET (MN2)) after initiation of the voltage regulator circuit. As a result, rising of the gate-source voltage of the output transistor is promoted and the rise time of the output voltage Vout can be shortened. In addition, the gate-source voltage (Vgs2 or Vgs5) of the transistor for outputting the adjustment current (n-channel MOSFET (MN1) or p-channel MOSFET (MP3)) becomes less than the threshold voltage (Vth2 or Vth5) before the output voltage Vout reaches the design value, that is, the target value, and the acceleration effect due to the adjustment current (Ids2 or Ids5) is stopped. After that, the output voltage Vout rises to the target value at a slower response speed determined by the band (AC characteristics) of the voltage regulator circuits 100A to 100J, which is determined by the circuit of the operational amplifier OP and the capacitance value of the capacitor C1, and therefore an overshoot is not generated.

Furthermore, the voltage regulator circuit 100C can supply a voltage Vset that is higher than the reference voltage Vref to the gate of the n-channel MOSFET (MN1) from outside the voltage regulator circuit 100C. As a result, the adjustment current Ids2 can be made to flow for a longer time compared with the voltage regulator circuit 100A. Therefore, the rise time of the output voltage Vout can be shortened even more.

In addition, the voltage regulator circuit 100D is provided with a booster circuit that includes the capacitor C2 and the switch circuit SW2. Therefore, a voltage that is higher than the reference voltage Vref can be supplied to the gate of the n-channel MOSFET (MN1). As a result, the adjustment current Ids2 can be made to flow for a longer time compared with the voltage regulator circuit 100A. Therefore, the rise time of the output voltage Vout can be shortened even more.

In addition, the voltage regulator circuit 100E is provided with a booster circuit that includes the current source J1 and the p-channel MOSFET (MP2). As a result, a voltage (Vref+Vgs3) obtained by boosting the reference voltage Vref by an amount equal to the gate-source voltage Vgs3 of the p-channel MOSFET (MP2) can be supplied to the gate of the n-channel MOSFET (MN1). Therefore, the adjustment current Ids2 can be made to flow for a longer time compared with the voltage regulator circuit 100A without necessarily considering the control signal sequence of the switch circuit SW2 as in the voltage regulator circuit 100D. Therefore, the rise time of the output voltage Vout can be shortened even more.

In addition, the voltage regulator circuits 100F and 100G further include the comparator COMP. Consequently, a high-level voltage or a low-level voltage can be supplied to the gate of the n-channel MOSFET (MN1) in accordance with a comparison result between a voltage corresponding to the reference voltage Vref and the output voltage Vout. Therefore, the adjustment current Ids2 can be made to flow regardless of the threshold voltage Vth2 of the n-channel MOSFET (MN1). Therefore, compared with the voltage regulator circuit 100A, the adjustment current Ids2 can be made to flow for a longer time and the rise time of the output voltage Vout can be shortened even more.

In addition, the voltage regulator circuit 100J includes the p-channel MOSFET (MP3) instead of the n-channel MOSFET (MN1) and further includes the switch circuit SW3. Consequently, the output voltage Vout can be supplied to the gate of the p-channel MOSFET (MP3). Therefore, the timing at which the p-channel MOSFET (MP3) is turned off can be designed without necessarily considering the value of the reference voltage Vref.

In addition, the voltage regulator circuit 100I is further provided with the resistance element R3 and as a result the peak value of the adjustment current Ids2 that flows to the n-channel MOSFET (MN1) can be restricted. Thus, the generation of a current spike in the line that supplies the power supply voltage Vdd when the voltage regulator circuit 100I is initiated can be suppressed. In the other embodiments as well, resistance elements for restricting the sizes of the adjustment currents Ids2 and Ids5 can be provided similarly to as in the voltage regulator circuit 100I.

In addition, configurations the same as those of the embodiments illustrated in FIGS. 3 to 8 and 10 can also be adopted in a configuration in which an n-channel MOSFET is used as both the output transistor and the current output circuit as in the voltage regulator circuit 100H illustrated in FIG. 9.

Furthermore, in the n-channel MOSFET (MN1) of the voltage regulator circuits 100A to 100I illustrated in FIGS. 1 and 3 to 10, a back gate may be connected to the source of the n-channel MOSFET (MN1). As a result, the threshold voltage Vth2 of the re-channel MOSFET (MN1) is lower than in the case where the back gate is grounded. Therefore, compared with the case where the back gate is grounded, a state in which the gate-source voltage Vgs2 of the n-channel MOSFET (MN1) is higher than the threshold voltage Vth2 is maintained for a longer time. Therefore, the rise time of the output voltage Vout can be shortened even more.

In addition, regarding each of the MOSFETs of the voltage regulator circuits illustrated in FIGS. 1 and 3 to 11, a pnp bipolar transistor may be used instead of a p-channel MOSFET and an npn bipolar transistor may be used instead of an n-channel MOSFET.

The purpose of the embodiments described above is to enable easy understanding of the present disclosure and the embodiments are not to be interpreted as limiting the present disclosure. The present disclosure can be modified or improved without departing from the gist of the disclosure and equivalents to the present disclosure are also included in the present disclosure. In other words, appropriate design changes made to the embodiments by one skilled in the art are included in the scope of the present disclosure so long as the changes have the characteristics of the present disclosure. For example, the elements included in the embodiments and the arrangements, materials, conditions, shapes, sizes and so forth of the elements are not limited to those exemplified in the embodiments and can be appropriately changed. In addition, the elements included in the embodiments can be combined as much as technically possible and such combined elements are also included in the scope of the present disclosure so long as the combined elements have the characteristics of the present disclosure.

While embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A voltage regulator circuit that outputs an output voltage that corresponds to a reference voltage, the voltage regulator circuit comprising:

an output transistor that has first, second, and third electrodes and controls the output voltage by making an output current flow between the first electrode and the second electrode according to a first differential voltage, the first differential voltage being a difference between a voltage at the first electrode and a voltage at the third electrode;

an operational amplifier that controls the voltage at the third electrode such that the output voltage reaches a target level;

an initiation circuit that maintains the voltage such that the output transistor is off before initiation of the voltage regulator circuit and that allows the second voltage to be controlled by the operational amplifier after initiation of the voltage regulator circuit; and a current output circuit that outputs an adjustment current from the third electrode or to the third electrode such that the first differential voltage becomes larger when the output voltage is less than a predetermined level.

2. The voltage regulator circuit according to claim 1, wherein the current output circuit includes a first transistor that has fourth, fifth, and sixth electrodes, the first transistor makes the adjustment current flow between the fourth and fifth electrodes according to a second differential voltage, the second differential voltage being the difference between a voltage at the fourth electrode and a voltage at the sixth electrode, and the voltage at the fourth electrode is a voltage that changes such that the second differential voltage becomes smaller in as the output voltage rises.

3. The voltage regulator circuit according to claim 2, wherein the voltage at the sixth electrode is the reference voltage.

4. The voltage regulator circuit according to claim 2, wherein the voltage at the sixth electrode is a voltage that is supplied from outside the voltage regulator circuit.

5. The voltage regulator circuit according to claim 2, further comprising:

a booster circuit that generates the voltage at the sixth electrode from the reference voltage, the voltage at the sixth electrode being higher than the reference voltage.

6. The voltage regulator circuit according to claim 5, wherein the booster circuit includes a capacitor and a switch circuit, and the switch circuit supplies the reference voltage to one end of the capacitor and grounds another end of the capacitor before initiation of the voltage regulator circuit, and supplies the reference voltage to the other end of the capacitor and outputs a voltage greater than the reference voltage to the sixth electrode after initiation of the voltage regulator circuit.

7. The voltage regulator circuit according to claim 5, wherein the booster circuit includes a second transistor that has seventh, eighth, and ninth electrodes, the second transistor has the reference voltage supplied to the ninth electrode thereof and makes a current flow from the seventh electrode to the eighth electrode according to a third differential voltage, the third differential voltage being the difference between a voltage at the seventh electrode and a voltage at the ninth electrode, and the voltage at the sixth electrode is the same as a voltage at the seventh electrode.

8. The voltage regulator circuit according to claim 2, further comprising:

a comparator that controls the voltage at the sixth electrode to a first level or a second level based on a comparison of a voltage that corresponds to the reference voltage and a voltage that corresponds to the output voltage;

wherein when the voltage corresponding to the output voltage is lower than the voltage corresponding to the reference voltage, the comparator controls the voltage at the sixth electrode to the first level such that the first transistor can output the adjustment current, when the voltage corresponding to the output voltage is higher than the voltage corresponding to the reference voltage, the comparator controls the voltage at the sixth electrode to the second level such that the first transistor cannot output the adjustment current.

9. The voltage regulator circuit according to claim 7, further comprising:

a comparator that controls the voltage at the sixth electrode to a first level or a second level based on a comparison of a voltage that corresponds to the reference voltage and a voltage that corresponds to the output voltage;

wherein when the voltage corresponding to the output voltage is lower than the voltage corresponding to the reference voltage, the comparator controls the voltage at the sixth electrode to the first level such that the first transistor can output the adjustment current, when the voltage corresponding to the output voltage is higher than the voltage corresponding to the reference voltage, the comparator controls the voltage at the sixth electrode to the second level such that the first transistor cannot output the adjustment current.

10. The voltage regulator circuit according to claim 2, further comprising:

a switch circuit;

wherein the switch circuit supplies a voltage that maintains the first transistor in an off state to the sixth electrode before initiation of the voltage regulator circuit, and supplies a voltage that corresponds to the output voltage to the sixth electrode after initiation of the voltage regulator circuit.

11. The voltage regulator circuit according to claim 2, wherein the first transistor is a MOSFET, and a back gate of the MOSFET is connected to a source of the MOSFET.

12. The voltage regulator circuit according to claim 10, wherein the first transistor is a MOSFET, and a back gate of the MOSFET is connected to a source of the MOSFET.

13. The voltage regulator circuit according to claim 1, further comprising:

a resistance element between the third electrode and the current output circuit.

14. The voltage regulator circuit according to claim 1, further comprising:

a capacitor that provides phase compensation;

wherein one end of the capacitor is connected to the third electrode.

15. The voltage regulator circuit according to claim 14, wherein another end of the capacitor is connected to the second electrode.

16. The voltage regulator circuit according to claim 2, wherein the first transistor is a P-channel MOSFET.

17. The voltage regulator circuit according to claim 2, wherein the first transistor is an N-channel MOSFET.

18. The voltage regulator circuit according to claim 2, wherein the output transistor is a P-channel MOSFET.

* * * * *